United States Patent [19]

Wechner

[11] Patent Number: 4,919,252

[45] Date of Patent: Apr. 24, 1990

[54] CHAIN CONVEYOR FOR MINER

[75] Inventor: Edward Wechner, Minnamurra, Australia

[73] Assignee: Joy Technologies Inc., Pittsburgh, Pa.

[21] Appl. No.: 162,836

[22] Filed: Mar. 3, 1988

[30] Foreign Application Priority Data

Mar. 5, 1987 [AU] Australia ..... PI0701

[51] Int. Cl.[5] ..... B65G 45/00

[52] U.S. Cl. ..... 198/494; 198/834; 198/520

[58] Field of Search ..... 198/813, 814, 516, 520, 198/850, 851, 853, 729, 733, 728, 834, 834; 299/43, 44, 46, 64; 474/101, 111, 140, 144

[56] References Cited

U.S. PATENT DOCUMENTS

| | | | |
|---|---|---|---|
| 191,911 | 6/1877 | Woodward | 198/850 X |
| 1,335,673 | 3/1920 | Elledge | 198/853 |
| 2,766,979 | 10/1956 | Calder | 198/498 X |
| 3,190,699 | 6/1965 | Ward | 299/64 |
| 4,642,073 | 2/1987 | Ancarani Restelli | 474/111 |

FOREIGN PATENT DOCUMENTS

| | | | |
|---|---|---|---|
| 1111228 | 2/1956 | France | 474/101 |
| 240959 | 10/1925 | United Kingdom | 424/140 |

*Primary Examiner*—Robert J. Spar
*Assistant Examiner*—D. Glenn Dayoan
*Attorney, Agent, or Firm*—Kirkpatrick & Lockhart

[57] ABSTRACT

A chain conveyor for a miner in which the chain adjacent the drive sprocket is guided and supported by channels in a casting such that tension in the chain is reacted by the casting and separated from the driving force applied to the chain by the drive sprocket. The casting may be spring loaded away from the idler sprocket at the other end of the conveyor. The pitch of the sprocket teeth is preferably less than the pitch of the chain, allowing for drive sprocket build up from entrained fines.

5 Claims, 5 Drawing Sheets

CHAIN CONVEYOR FOR MINER

BACKGROUND OF THE INVENTION

This invention relates to a chain conveyor for a miner and has been devised particularly though not solely for use as a transverse face conveyor.

In many types of mining operations, mining machines are provided having various types of cutter heads which cut the material to be mined, e.g. coal, from the coal face whereupon it falls to the ground beneath the cutting head. The particulate coal then requires to be collected and delivered to a central point on the miner for final delivery. The collection of coal from the face can be carried out by transverse face conveyors of the type shown in FIGS. 1 and 2 of the drawings accompanying this specification and also typically described in our co-pending Australian patent application 53776/86, corresponding to U.S. patent application Ser. No. 847,968, filed 3 Apr. 1986. The transverse face conveyors comprise a number of strands of chain engaged over a drive sprocket at one end of the conveyor and a parallel idler sprocket at the other end.

Chain conveyors of this type are prone to a number of problems when mining particulate materials such as coal which breaks down into material including "fines" (generally defined as coal dust and particles less than 5 mm in size) which penetrate between the links in the chain conveyor causing jamming problems due to the build up of fines within the conveyor. These problems take two major forms, firstly excessive friction on the return side of the chain due to the presence of fines under pressure between the beam which extends between the upper and lower chain runs and the lower run of chain, and secondly the phenomenon known as drive sprocket build up. In the latter phenomenon fines can build up between the chain links and the teeth in the drive sprocket causing an increase in the effective pitch circle diameter of the chain over the sprocket which either causes the chain links to jam against the adjacent gear box castings or tensions the chain to such a degree that the drive motor will jam or stall. Attempts to overcome these problems, e.g. by increasing clearance between the drive sprocket and the adjacent gear box housing or by introducing irregularities in the chain which displace and remove the fines, cause minor improvements in the situation but generally cannot overcome these problems when mining difficult materials such as coal. The coal fines sometimes behave like a hydrostatic fluid building up "head" pressure on the return run of chain between the lower skid plate of the transverse conveyor and the conveyor beam, eventually causing the drive motor to stall.

BRIEF SUMMARY OF THE INVENTION

The present invention therefore provides a chain conveyor of the type having a drive sprocket at one end of the conveyor, a parallel idler sprocket at the opposite end of the conveyor, and one or more strands of chain engaged over the sprockets providing a moving surface for the conveying of particulate material, characterised by the provision of an entry casting adjacent the drive sprocket, having channels therethrough shaped and located to guide and support the chain links passing over the drive sprocket such that tension in the chains is reacted by the entry casting and separated from the driving force applied to the chains by the drive sprocket.

Preferably the channels through the entry casting are configured to provide a close fit around the chain links where the links enter the entry casting.

Preferably the chain links are provided with scraper blades arranged to scrape the adjacent surfaces of the entry casting upon entry of the links into the casting.

Preferably the chain links are configured with curved cheeks corresponding with the configuration of curved channels through the entry casting which serve to guide and support the chain links passing therethrough.

Preferably the drive sprocket has a small number of large teeth and the chain links are accordingly large in size with large cavities therethrough sized to fit over the sprocket teeth.

Preferably the drive sprocket has five teeth.

Preferably the entry casting is spring loaded and arranged to bias the entry casting away from the idler sprocket and tension the chains.

Preferably the pitch of the sprocket teeth is less than the pitch of the chain links.

BRIEF DESCRIPTION OF THE DRAWINGS

Notwithstanding any other forms that may fall within its scope, one preferred form of the invention will now be described by way of example only with reference to the accompanying drawings, in which.

DETAILED DESCRIPTION OF THE PREFERRED EMBODIMENT

Figure 1:
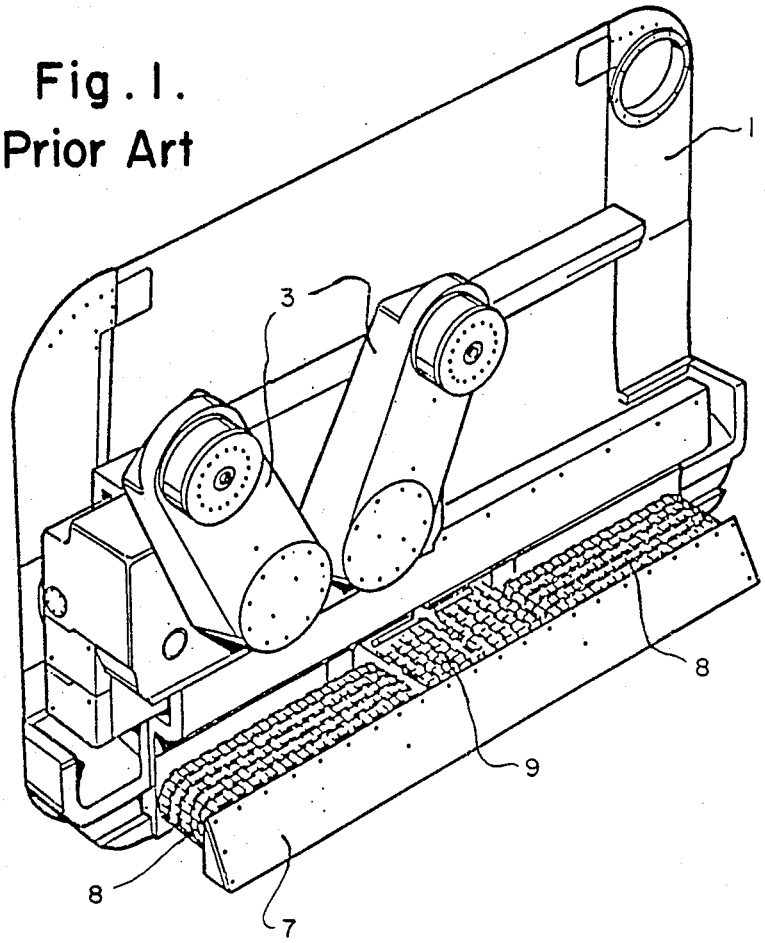
Fig. 1. Prior Art
FIG. 1 is a general perspective view of the "front end" of a continuous miner incorporating transverse face chain conveyors according to the invention (with the cutting heads of the miner removed for clarity)

In FIG. 1 there is shown the "front end" or cutting face of a mining machine 1 which typically has cutting drums 2 (shown in FIG. 2 but omitted from FIG. 1 for clarity) mounted on ranging arms 3. The miner is normally moved in the direction shown by arrow 4 in FIG. 2 and the cutting heads 2 operated to cut minerals such as coal from the face 5 whereupon the cut coal falls into the area 6 beneath the cutting heads 2. The particulate coal is forced by forward movement of the mining machine up an inclined apron 7 onto transverse face conveyors 8 where the particulate coal is conveyed inwardly to a central longitudinal conveyor 9 which conveys the coal through the center of the machine where it is discharged from a discharge conveyor 10 into shuttle cars or other disposal means. The present invention is concerned with the design of the transverse face conveyors 8, and provides a superior design of chain conveyor which is particularly suitable for use as a transverse face conveyor.

Figure 3:
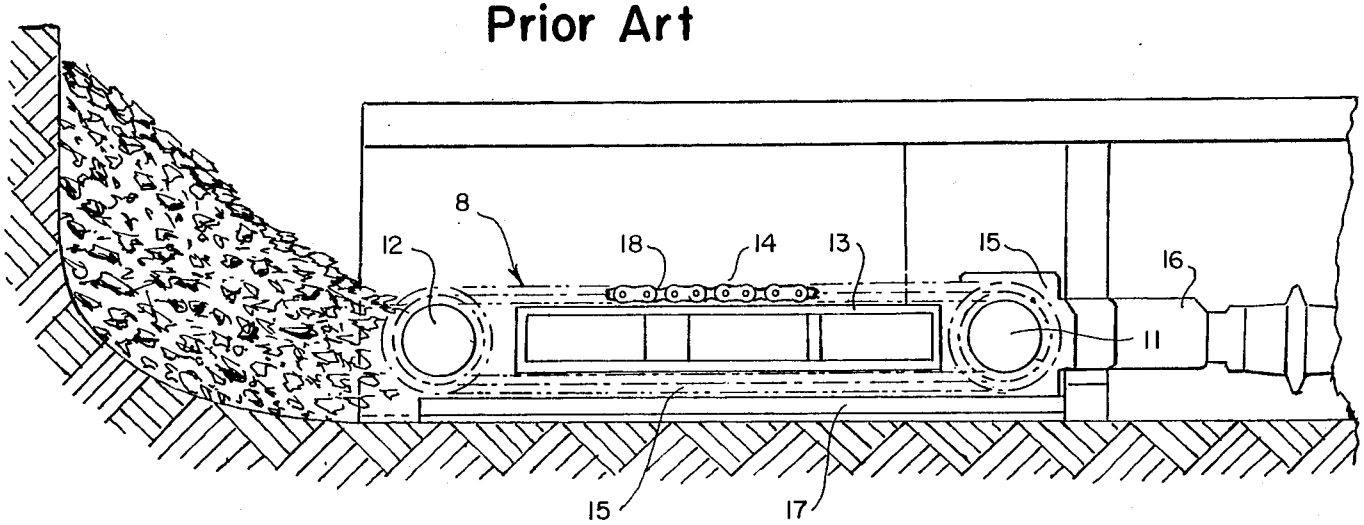
Fig. 3. Prior Art
FIG. 3 is a diagrammatic frontal view of a chain conveyor according to the invention in use as a transverse face conveyor on a miner of the type shown in FIGS. 1 and 2.

The chain conveyor can be seen in greater detail in FIG. 3 which is a frontal view of the lower part of a mining machine wherein it can be seen that the chain conveyor 8 is driven by a drive sprocket 11 at one end of the conveyor and entrained over a parallel idler sprocket 12 at the opposite end. The conveyor is provided with a beam 13 extending through the conveyor between the upper run of chain 14 and the lower run 15, and the inclined apron 7 (FIG. 1) is normally mounted on the forward end of the beam 13. The drive sprocket is driven from a drive shaft through a gear box 15 which in turn is driven by a conveyor gear case 16 typically from the footh shaft of the longitudinal conveyor 9. One form of conveyor drive mechanism is described in our co-pending Australian patent application 53776/86, corresponding to U.S. patent application Ser. No. 847,968, filed 3 Apr. 1986. The chain conveyor is also typically provided with a skid plate 17 located beneath the lower run of chain 15 to prevent problems from slack in the chain building up after leaving the drive sprocket 11 which might otherwise press into the floor and stall the conveyor.

Figure 2:
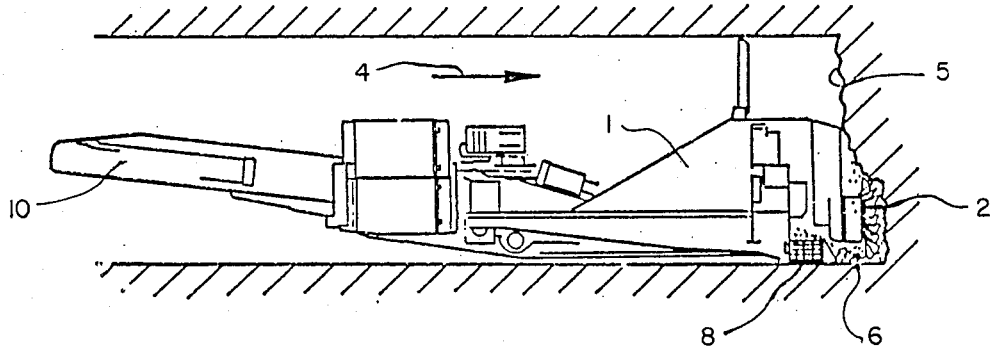
Fig. 2. Prior Art
FIG. 2 is a side view of a continuous miner of the type described, in operation.

FIGS. 1, 2 and 3 generally show a transverse face conveyor of known type in which a number of strands of chain are located side by side on the conveyor and incorporate links of the general configuration shown at 18 in FIG. 3.

The present invention improves the design of such chain conveyors to overcome the problems enunciated in the preamble to this specification by a particular design which will now be described with reference to FIGS. 4–6.

Figure 4:
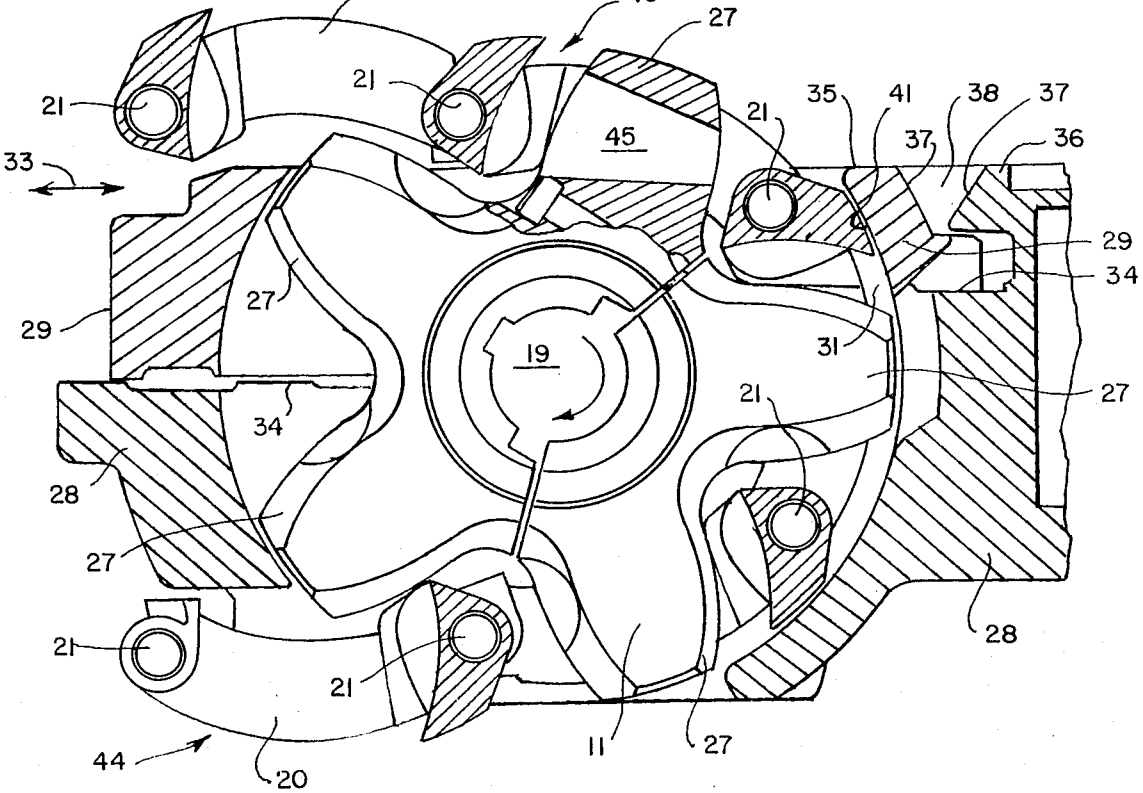
FIG. 4 is a cross-sectional elevation through the drive sprocket and entry casting of a chain conveyor according to the invention.

In FIG. 4 there is shown the drive sprocket 11 of the chain conveyor which is mounted on and driven by a drive shaft 19. The drive sprocket has a small number (typically five as shown in FIG. 4) of teeth which engage large chain links 20 each connected one to the other by link pins 21.

Figure 5A:
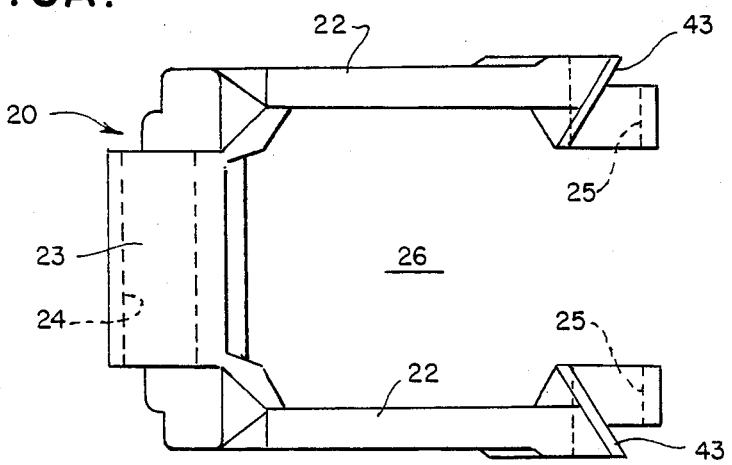
FIGS. 5A, 5B and 5C are plan view, side view, and underside view respectively of a chain link used in the chain conveyor according to the invention.
Figure 5B:
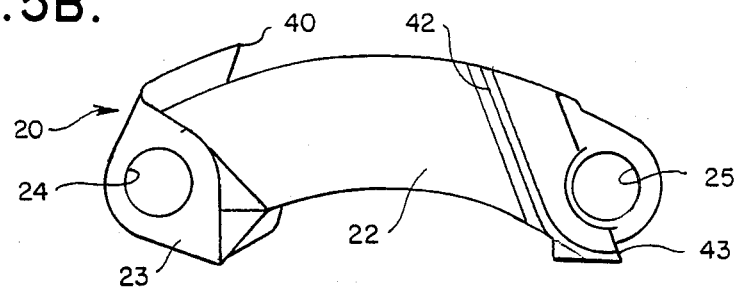
Figure 5C:
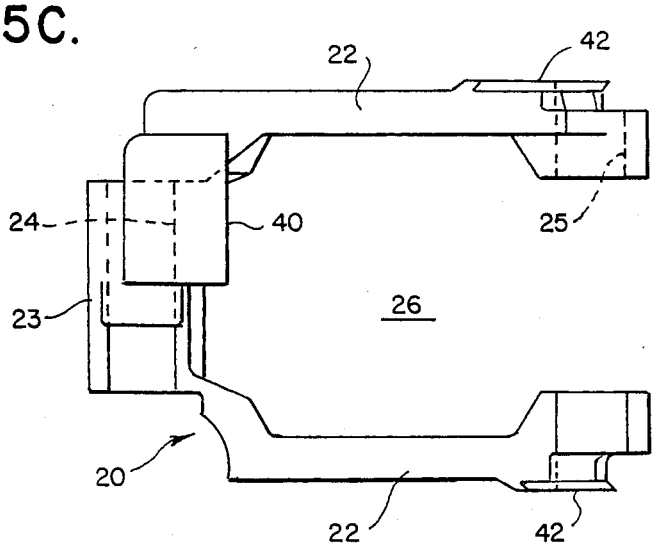

The chain links are shown in more detail in FIGS. 5A, 5B and 5C wherein it can be seen that each link comprises curved cheek plates 22 connected by a boss 23 which has a hole 24 therethrough adapted to receive the link pins 21 which then pass through aligned holes 25 in the "free ends" of the cheek plates 22 of the adjacent link. The cheek plates 22 and boss 23 define between them a large cavity 26 which is adapted to fit over and be driven by the teeth 27 of the drive sprocket 11.

The drive sprocket is located adjacent an entry casting formed in two pieces, namely a gear box casting 28 and a spring loaded floating entry casting member 29. For convenience the two castings 28 and 29 are generally referred to throughout this specification as the entry casting. Although the entry casting component 28 has been referred to as a "gear box casting" because it normally forms part of the casting used for the drive gear box of the chain conveyor, it will be appreciated that the "gear box" casting could be a specific casting quite separate from the actual gear box.

Figure 6A:
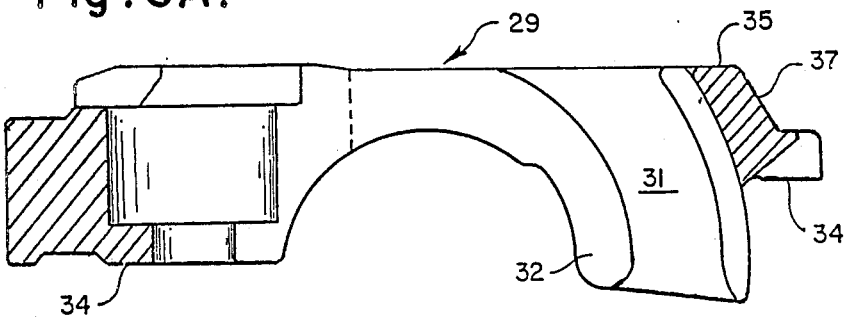
FIGS. 6A and 6B are cross-sectional elevation and plan view respectively of the entry casting used in the chain conveyor according to the invention.
Figure 6B:
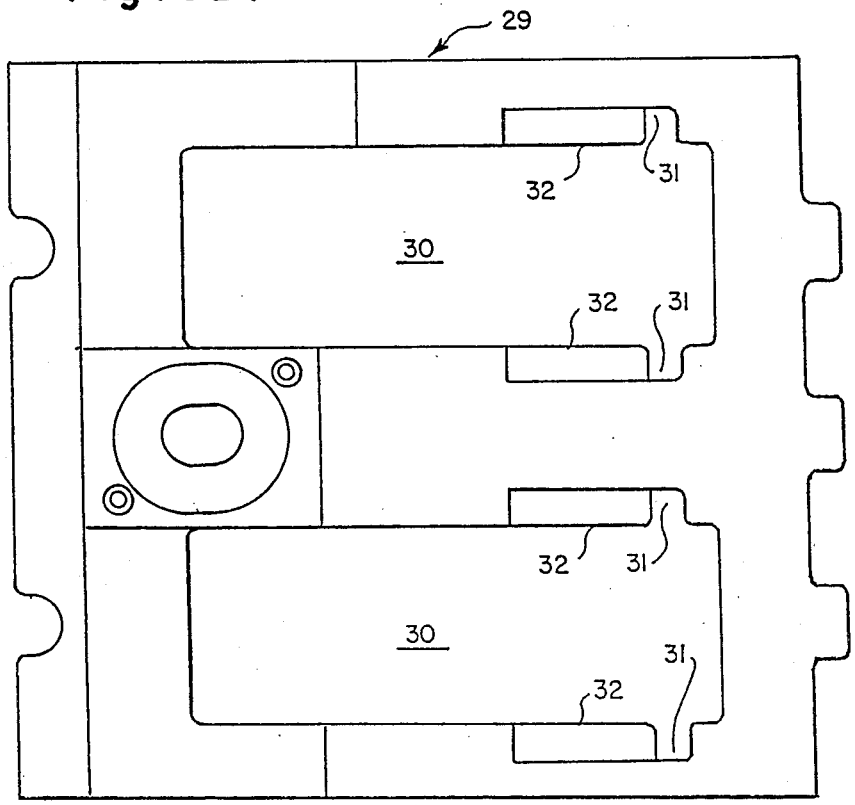

The entry casting member 29 is shown in greater detail in FIGS. 6A and 6B where it can be seen from the FIG. 6B plan view that two openings 30 are provided in the entry casting. The conveyor described in conjunction with FIGS. 4–6 incorporates two strands of chain links 20 each of which is engaged with one of the apertures 30 in the entry casting member. Similarly the drive sprocket 11 incorporates two sprocket wheels positioned side by side, one in each of the openings 30. It will be appreciated however that the chain conveyor could comprise any number of strands of chain links 20 in which case further sprocket members 11 and apertures 30 in the entry casting would be provided.

The entry casting is configured to incorporate curved channels 31 in the internal side walls 32 of the apertures 30, and the channels 31 serve to guide and support the chain links passing over the drive sprocket 11 such that tension in the chains is reacted by the entry casting and separated from the driving force applied to the chains by the drive sprocket. In this sense the chain conveyor according to the invention is fundamentally different from prior art conveyors where the drive sprocket serves not only to drive the chain but also to support and locate the chain at that end of the conveyor. In the chain conveyor according to the present invention, the chain is located and supported adjacent the drive sprocket by the channels 31 in the entry casting, and the sprocket serves only to drive the chain.

In order to tension the chain and to provide for the sprocket growth phenomenon described earlier, the entry casting member 29 is free to move relative to the gear box casting 28 in the sense shown by arrow 33 and is supported by sliding bearing surfaces 34. The entry casting member 29 is biased in a direction away from the idler sprocket 12 by way of a spring pack (not shown) to provide the required tension in the chain. Where the upper surface 35 of the entry casting member is adjacent the upper surface 36 of the gear box casting, inclined edge surfaces 37 may be provided so that coal particles and fines falling into the V-notch aperture 38 are forced upwardly by relative movement of the upper casting member 29 and the gear box casting 28 so as to prevent jamming due to the ingress of coal between the two members.

The chain links are also provided with scrapers on all sides to keep the channels in the entry casting clear and free from fines that would otherwise cause jamming. The top scraper 40 (FIG. 5B) cleans the surface of the skid plate 17 (FIG. 3) as well as the forward face 41 of the entry casting. The side scrapers 42 clean the skid plate sides and the vertical side walls of the channels 31 in the entry casting. The lower scrapers 43 clean the surface of the conveyor beam 13 (FIG. 3), preventing the intermittent chain lift effect which would otherwise be encountered.

The chain links are bowed as can be seen in FIG. 5B to fit into the shape of the curved channels 31 in the entry casting. Movement is constrained by the cheeks 22 which slide in the channels of the entry casting, preventing the scrapers from fouling and minimizing gaps which would introduce fines into the entry casting. One of the design criterion of the links, sprocket teeth, and the upper surface of the entry casting is to keep the upwardly facing gaps to a minimum to control the downward ingress of fines into the entry casting area.

To this end the sprocket teeth 27 are designed to fill the gaps 26 in the chain while leaving the minimal operational clearance. Fines which do enter the voids between the sprocket, chain links, and entry casting member 29 can fill the void 26 left in the link as the sprocket disengages (e.g. at position 44-FIG. 4) so that the fines are transported out along the lower chain run 15 between the chain and the skid plate 17 where they can harmlessly exit from the conveyor at the idler sprocket 12, or alternatively are carried over onto the upper chain run 14 where they are forced out by the entry of the teeth 27 of the drive sprocket 11 and conveyed onto the central conveyor 9.

To assist the fines clearing operation a tapered cavity 45 is cast into each tooth to collect any coal being crushed during engagement of the chain. The reverse taper releases these fines just after the chain disengages at position 44.

The drive sprocket 11 has a pitch slightly shorter than the pitch of the chain providing a drive, during normal operation, at the entering link position 46. Any sprocket "growth" due to compacted fines will progressively transfer the drive further around the sprocket. This action assists in displacing the compacted fines and allows the entry casting to move without locking the sprocket.

To accommodate any increase in the effective pitch circle diameter of the chain, due to build up of coal on the drive sprocket 11, the entry casting member 29 can slide relative to the gear box casting 28 as previously described. A returning force will always be available due to chain tension.

In this manner a chain conveyor is provided, particularly suitable for use in a miner, where the problems due to sprocket build up leading to jamming are overcome by separating the chain location and guiding functions from the drive sprocket 11 and incorporating those functions into an entry casting which can move to accommodate the increase in pitch circle diameter of the chain passing over the drive sprocket due to fines build up. The invention also provides particular design of sprocket tooth and chain link configuration which enables any fines which enter the entry casting to be quickly and effectively dealt with and transported from the area where they may cause conveyor jamming.

I claim:

1. An improved chain conveyor of the type having a drive sprocket at one end of the conveyor, a parallel idler sprocket at the opposite end of the conveyor, and one or more links of chain engaged over the sprockets providing a moving surface for the conveying of particulate material, wherein the improvement comprises an entry casting adjacent the drive sprocket, and wherein the drive sprocket has no more than five teeth and the chain links are accordingly sized with cavities therethrough to fit over the sprocket teeth, the entry casting having channels therethrough shaped and located to guide and support the chain links passing over the drive sprocket such that tension in the chains is reacted by the entry casting, and wherein each tooth of the drive sprocket has an aperture therethrough in the direction of rotation of that tooth, the aperture being tapered from a relatively narrow cross section at the leading face of the tooth to a relatively wide cross section at the trailing face of the tooth to avoid a build-up of fine particulate material between the chain links and the sprocket teeth.

2. A chain conveyor as claimed in claim 1 wherein the chain links are provided with scraper blades arranged to scrape the adjacent surfaces of the entry casting upon entry of the links into the casting.

3. A chain conveyor as claimed in claim 1 wherein the chain links are configured with curved cheeks corresponding with the curvature of the channels through the entry casting which serve to guide and support the chain links passing therethrough.

4. A chain conveyor as claimed in claim 1 wherein the drive sprocket has five teeth.

5. A chain conveyor as claimed in claim 1 wherein the pitch of the sprocket teeth is less than the pitch of the chain links to assist in the displacement of fines.

* * * * *

UNITED STATES PATENT AND TRADEMARK OFFICE

CERTIFICATE OF CORRECTION

PATENT NO. : 4,919,252

DATED : April 24, 1990

INVENTOR(S) : Edward Wechner

It is certified that error appears in the above-identified patent and that said Letters Patent is hereby corrected as shown below:

Col. 3, line 15, delete "footh" substitute therefor --foot--.

Signed and Sealed this

Seventeenth Day of September, 1991

*Attest:*

HARRY F. MANBECK, JR.

*Attesting Officer*

*Commissioner of Patents and Trademarks*